US006192660B1

(12) United States Patent
Moriyama et al.

(10) Patent No.: US 6,192,660 B1
(45) Date of Patent: Feb. 27, 2001

(54) CAP APPLYING APPARATUS

(75) Inventors: Yasuyuki Moriyama, Funabashi (JP); Elmar Mock, Biel (CH); Michio Sugata; Shigeo Katsumata, both of Yokohama (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/230,825

(22) PCT Filed: Aug. 11, 1997

(86) PCT No.: PCT/US97/14128

§ 371 Date: Jun. 3, 1999

§ 102(e) Date: Jun. 3, 1999

(87) PCT Pub. No.: WO98/06628

PCT Pub. Date: Feb. 19, 1998

(30) Foreign Application Priority Data

Aug. 12, 1996 (JP) ..... 8-212340

(51) Int. Cl.[7] ..... B65P 51/10

(52) U.S. Cl. ..... 53/478; 53/141; 53/290; 53/329.2; 53/373.9; 53/75; 156/69; 156/82

(58) Field of Search ..... 156/69, 82, 497; 53/141, 75, 167, 290, 329.2, 370.8, 370.9, 373.8, 373.9, 406, 426, 478

(56) References Cited

U.S. PATENT DOCUMENTS 2,252,854 * 8/1941 Hubner et al. .
2,284,631 6/1942 Bell .
2,387,439 10/1945 Grabus, Jr. et al. .
2,518,856 8/1950 Bell .
2,549,808 * 4/1951 Heinle et al. .
2,551,476 5/1951 Vantlander .
2,618,424 11/1952 Stover .
3,128,215 * 4/1964 Hood et al. .
3,191,223 * 6/1965 Quinche et al. .
4,442,129 * 4/1984 Niwa et al. .
4,556,445 * 12/1985 McCormick .

FOREIGN PATENT DOCUMENTS 421740 4/1967 (CH) .

* cited by examiner

*Primary Examiner*—Peter Vo
*Assistant Examiner*—Louis Huynh
(74) *Attorney, Agent, or Firm*—Burns, Doane, Swecker & Mathis, L.L.P.

(57) ABSTRACT

An apparatus for supplying and applying cap bodies (51) to a packaging container includes a gas supplying device (11) which supplies a hydrogen-oxygen gas mixture obtained by electrolyzing water, a burner unit (22) that is connected to the gas supplying device (11) for receiving hydrogen-oxygen gas mixture from the gas supplying device (11) and burning the hydrogen-oxygen gas mixture and a pickup apparatus (80) which transports a cap body (51) to a heating position above the burner unit (22). The burner unit (22) is provided with a plurality of nozzles (31) that are arranged in a pattern that corresponds in shape to the shape of the underside periphery of the cap body (51). A shield plate (57) is positionable above the nozzles (31) to deflect the hydrogen-oxygen gas mixture emitted from the nozzles (31), and an igniter (32) is disposed adjacent one of the nozzles (31), to ignite the mixture emitted from the nozzle (31). The other nozzles (31) are then ignited as the hydrogen-oxygen mixture from such nozzles (31) is deflected by the shield plate (57). A CCD camera (31) is also provided for monitoring the flame emitted from each of said nozzles (31).

20 Claims, 8 Drawing Sheets

FIG. 6
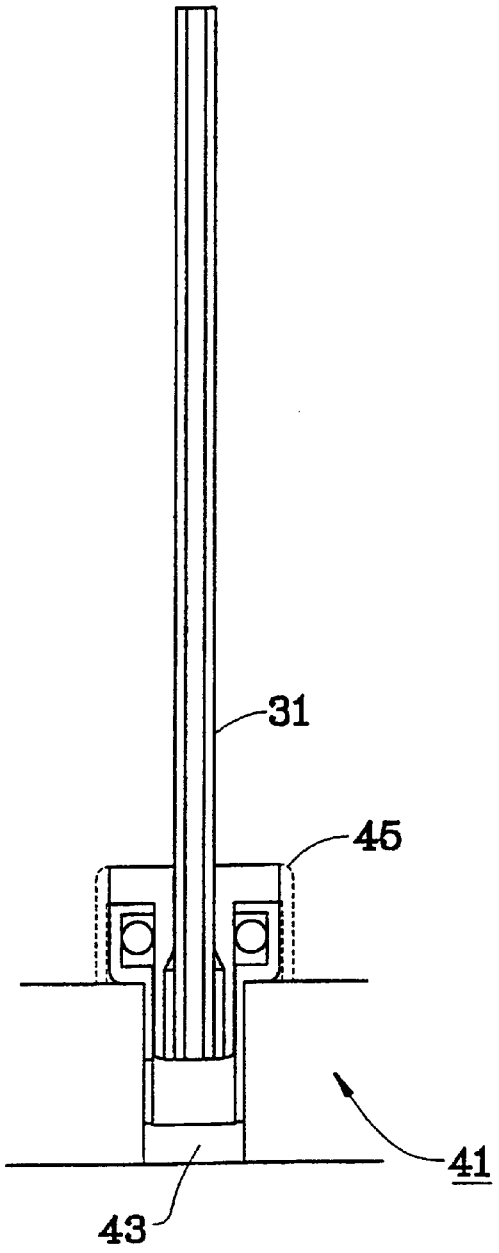
FIG. 7
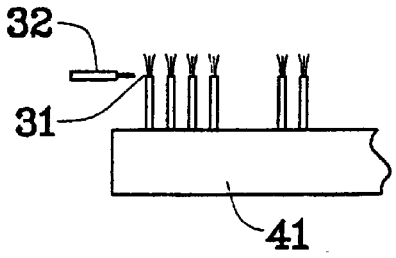
FIG, 8
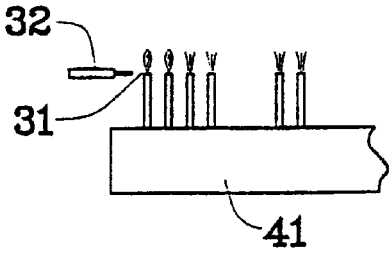
FIG. 9
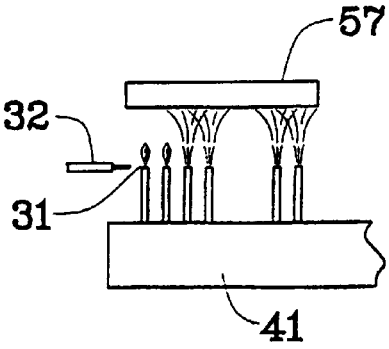

CAP APPLYING APPARATUS

FIELD OF THE INVENTION

This invention generally relates to a cap applying apparatus. More particularly, the present invention relates to an apparatus for applying a cap body to a packaging container.

BACKGROUND OF THE INVENTION

Brick-shaped packaging containers for holding liquid food products such as milk, carbonated drinks and the like are provided with a cap body that is adapted to be opened and closed as required so that the liquid food product can be repeatedly poured out and dispensed from the container. In these types of containers, the cap body is usually applied to the top portion of the packaging container by a hot melt process, a heat sealing process, an ultrasonic sealing process or other similar techniques.

In the case of the hot melt process, glue in a liquid state is ejected from a hot melt gun nozzle onto the portion of the packaging container where the cap body is to be applied. When the cap body is then applied to the container, the cap body is glued in place on the packaging container.

With the heat sealing process, hot air is blown onto the portion of the packaging container where the cap body is to be applied to melt the surface film of the packaging container. The cap body is then applied to the melted film where it becomes fixed in place.

With the ultrasonic seal process, ultrasonic waves are applied to the cap body while pressing the cap body against the portion of the packaging container where the cap body is to be applied. As a result, the surface film of the packaging container is melted and the cap body is secured to packaging container.

However, the conventional processes discussed above suffer from various disadvantages and drawbacks. With the hot melt process, it is difficult to apply the glue accurately and uniformly to the portion of the packaging container where the cap body is to be applied. As a result, it is difficult to apply the cap body to the packaging container in a manner that provides sufficient strength.

In the case of the heat sealing process, because the surface film of the packaging container is melted by blowing hot air on the portion of the packaging container where the cap body is to be applied, building up the hot air temperature takes a significant amount of time. Moreover, melting the film also requires a considerable amount of time. As a result, the processing speed with this process is rather slow.

With the ultrasonic sealing process, since the surface film of the packaging container is melted by ultrasonic waves, an ultrasonic wave apparatus is required. As a result, the cap body applying apparatus is quite expensive. Also, the melting of the film takes a significant amount of time. As a result, the speed associated with this process is also quite slow.

In light of the foregoing, a need exists for an improved cap body applying apparatus that is capable of applying the cap body to the packaging container in a relatively simple manner, with a high processing speed, and while maintaining sufficient strength at the cap body/packaging container interface.

SUMMARY OF THE INVENTION

To address the foregoing needs, the present invention provides a cap body applying apparatus for applying a cap body to a packaging container. The cap body applying apparatus includes a gas supplying device for supplying hydrogen-oxygen gas mixture obtained by electrolyzing water, a burner unit for receiving and burning the hydrogen-oxygen gas mixture, and a pickup apparatus for transporting a cap body to a heating position above the burner unit.

The above burner unit also includes a plurality of nozzles arranged in a pattern corresponding to the underside periphery of the cap body. The cap applying apparatus of the invention can further include a shield plate selectively disposed over each of the nozzles, and an igniter disposed adjacent one of the nozzles. A CCD camera can also be provided for monitoring the flames of the nozzles.

According to another aspect of the present invention, an apparatus for supplying and applying cap bodies to a packaging container includes a gas generator for supplying a hydrogen-oxygen gas mixture, and a burner unit connected to the gas generator for receiving the hydrogen-oxygen gas mixture. The burner unit includes a plurality of nozzles from which the hydrogen-oxygen gas mixture is emitted. An igniter is provided for igniting the hydrogen-oxygen gas mixture emitted from at least one of the nozzles to produce a flame at the tip of the nozzle. The apparatus also includes a transport device and a pickup apparatus mounted on the transport device for holding a cap body. The pickup apparatus is transported by the transport device to a heating position above the burner unit to permit the underside surface of the cap body to be heated by the flame emitted from the nozzles and is further transported from the heating position to an applying position at which the cap body is applied to a packaging container. A packaging container holder holds a packaging container to which is to be applied the cap body.

Another aspect of the invention involves a process for applying a cap body to a packaging container. The process includes positioning a cap body adjacent a burner unit that includes at least one nozzle that emits a flame, and heating the underside surface of the cap body with the flame that is emitted from the nozzle of the burner unit. The cap body with the heated underside surface is then applied to a packaging container to secure the cap body in position on the packaging container.

BRIEF DESCRIPTION OF THE DRAWING FIGURES

Further details and features of the present invention will become more apparent from the following detailed description considered with reference to the accompanying drawing figures in which like elements are designated by like reference numerals and wherein:

FIG. 6 is a cross-sectional view of the burner block with an attached nozzle;

FIG. 7 is a schematic illustration of how the nozzles are ignited;

FIG. 8 is a further schematic illustration showing how the nozzles are ignited;

FIG. 9 is another schematic illustration showing how the nozzles are ignited;

DETAILED DESCRIPTION OF THE INVENTION

Figure 1:
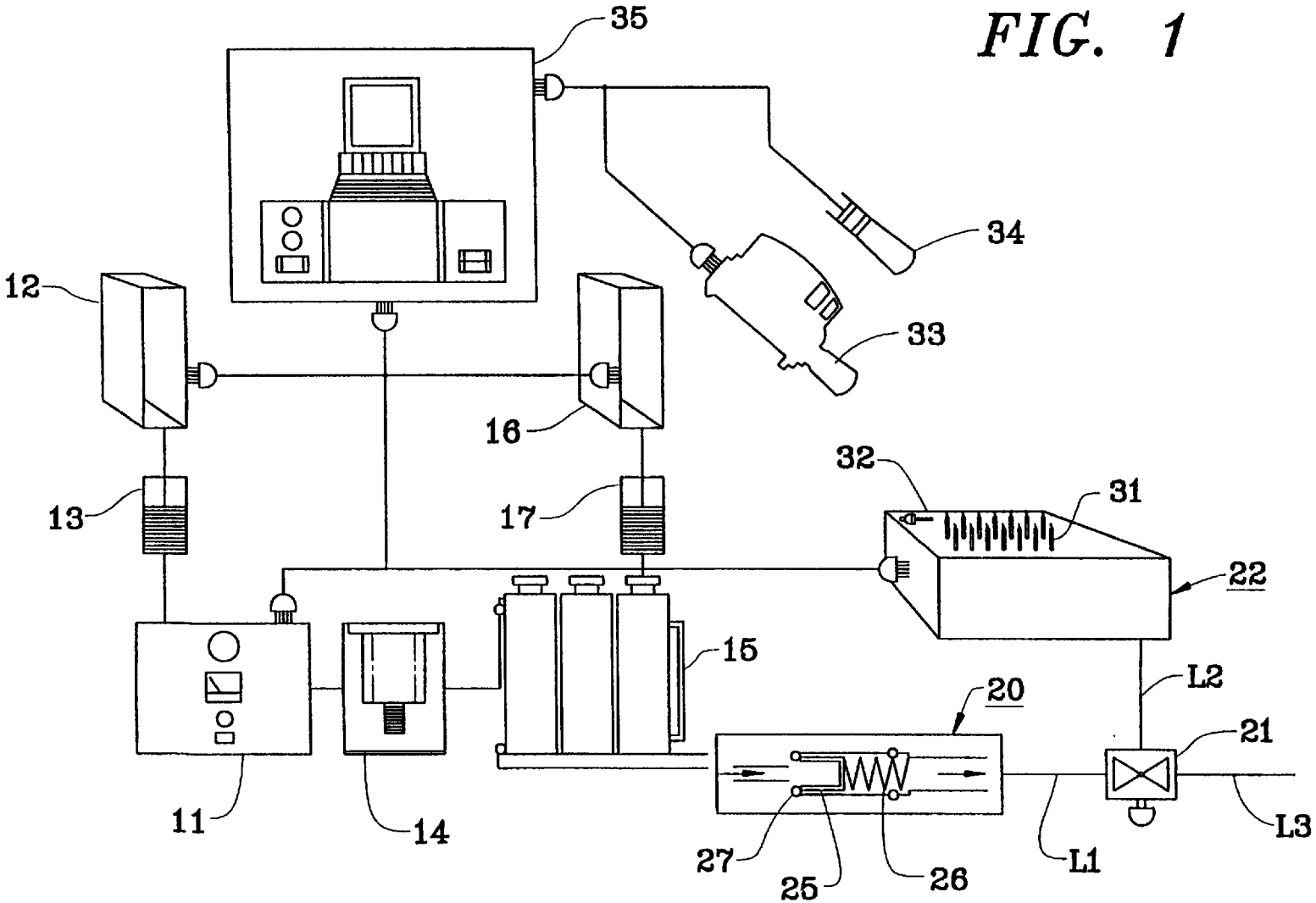
FIG. 1 is a schematic illustration of various components comprising the cap body applying apparatus of the present invention.

As seen with reference to FIG. 1, the cap body applying apparatus of the present invention includes a gas generator 11 for generating a hydrogen-oxygen mixture possessing a 2:1 mixture ratio by electrolyzing water, a tank 12 for holding water, and a water replenishing device 13 for replenishing water to the gas generator 11. The gas generator 11 constitutes the gas supplying device for supplying hydrogen-oxygen gas mixture.

The gas generator 11 is comprised of a plurality of cells and is capable of generating, for example, 100 liters of hydrogen-oxygen mixture when a DC current of 15 A is applied for one hour. Generally speaking, the generator breaks down water by electrolysis into its basic elements of two parts hydrogen and one part oxygen. The generator automatically mixes the hydrogen and oxygen to the optimal combustion ratio of 2:1. The hydrogen-oxygen mixture generated by the gas generator 11 is supplied through a filter 14 to a booster 15. The filter 14 is designed to clean the gas produced by the generator to remove aerosols, mists, etc. produced during the electrolysis of water.

The booster 15 consists of one or more tanks which hold methanol. The pure hydrogen-oxygen mixture gas mixture flows into the booster where it is enriched with combustible alcohol vapor. A hydrogen-oxygen gas mixture rich in methanol gas can be produced by injecting the hydrogen-oxygen gas mixture at the bottom of the booster tank(s). When the hydrogen-oxygen gas mixture is pure, the flame temperature is approximately 3200° C. With the methanol gas-rich hydrogen-oxygen gas mixture, although the flame temperature is low at 2500 degrees C., the amount of energy the flame has increases. That is, the combustion of the hydrogen together with the alcohol (methanol) lowers the flame temperature to between about 2500° C. and about 2700° C. while at the same time increasing or boosting the energy content of the flame. With the methanol gas-rich hydrogen-oxygen gas mixture, 70% of the energy the flame has is produced by burning hydrogen gas, while 30% is produced by burning methanol gas. Additional details associated with the generator 11, the filter 14 and the booster 15 are not be described here as such devices are known to persons skilled in the art.

As further seen in FIG. 1, the apparatus of the present invention also includes a tank 16 for holding methanol, and a replenishing device 17 for replenishing methanol to the booster 15. While methanol is used in this embodiment, other kinds of alcohol may be used in place of methanol.

The hydrogen-oxygen gas mixture is sent through a reverse flame check device 20 and a switching valve 21 to a burner unit 22. By virtue of the apparatus being designed so that the hydrogen-oxygen gas mixture produced by the gas generator 11 is burned in the burner unit 22, it is not necessary to store the hydrogen-oxygen gas mixture. As a result, the space occupied by the cap body applying apparatus can advantageously be reduced.

The reverse flame check device 20 is comprised of a cup-shaped filter 25 that is pressed by a spring 26 against an O-ring 27 so that the flame of the burner unit 22 is prevented from reversing. The switching valve 21 is positionable in two positions. In a first position, the switching valve 21 interconnects the lines L1 and L2, and in a second position, the switching valve 21 interconnects the lines L2 and L3. In the first position, the hydrogen-oxygen gas mixture from the booster 15 is supplied to the burner unit 22 for burning. In the second position, air from an air supply device is supplied to the burner unit 22 for extinguishing.

The burner unit 22 comprises a group or array of nozzles 31, with each nozzle 31 being provided with an opening from which hydrogen-oxygen gas mixture is ejected to create a tiny flame. As a result, a group or array of tiny flames is created. An igniter 32 is disposed adjacent one of the nozzles 31 of the nozzle group to ignite all the nozzles 31.

A flame monitor camera 33 is disposed obliquely above the burner unit 22. At a position obliquely above the burner unit 22 is also disposed a gas detector 34 for detecting gas leakage and troubles or problems in the burner unit 22.

A controller 35 is also provided for overall control of the gas generator 11, the tanks 12, 16, and the burner unit 22. In one respect, the controller 35 starts the cap body applying apparatus automatically without requiring intervention by an operator. The controller 35 also controls the gas generation rate, the amount of hydrogen-oxygen gas mixture that is consumed, and the voltage applied to the gas generator 11. The system is designed so that the monitoring results of the flame monitor camera 33 and the detection results of the gas detector 34 are sent to the controller 35.

When the hydrogen-oxygen gas mixture is burned, no air (oxygen) is required. Also, no carbon dioxide is produced by the burning operation. Further, when the hydrogen-oxygen gas mixture containing a small amount of methanol is burned, only a small amount of air is required, and only a small amount of carbon dioxide is produced. Therefore, restrictive requirements associated with installing the cap body applying apparatus are eliminated. Moreover, hydrogen gas, even if it leaks, is relatively safe because of its highly diffusive nature.

Figure 2:
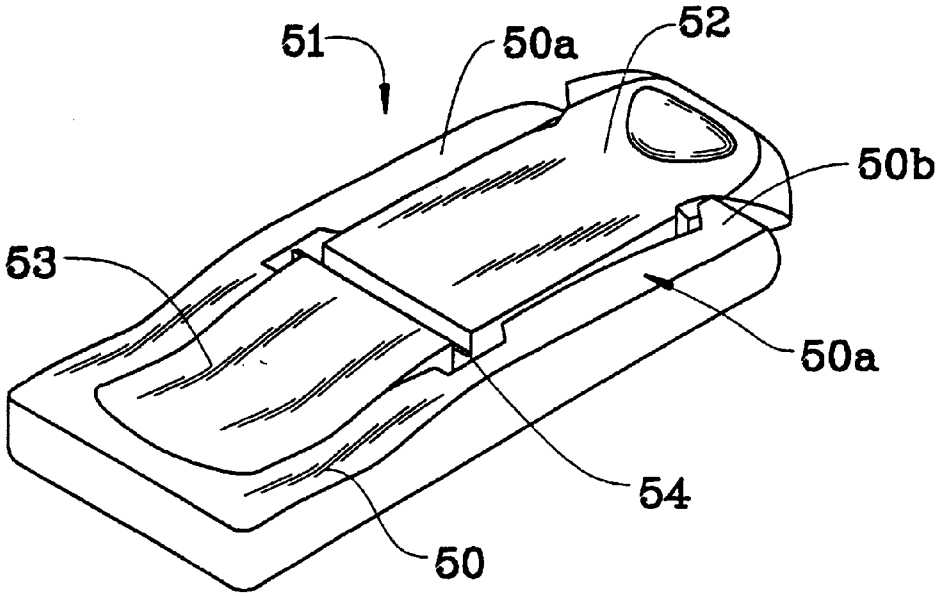
FIG. 2 is a perspective view of a cap body that is to be applied to a packaging container through use of the apparatus of the present invention.
Figure 3:
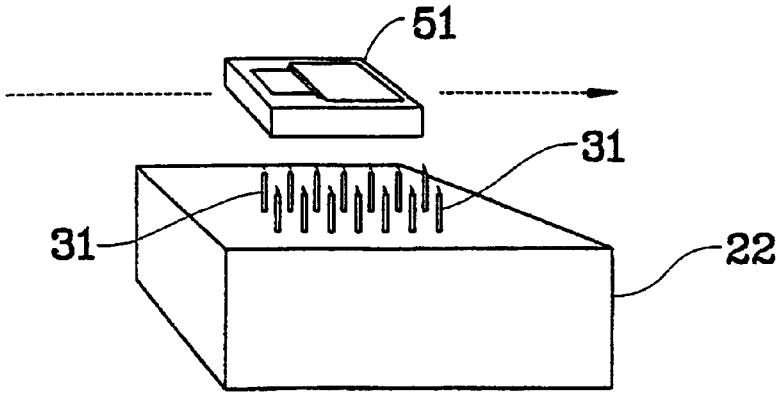
FIG. 3 is a schematic illustration of the way in which the cap body is heated.

The cap body that is to be to be applied to the packaging container through use of the apparatus of the present invention is illustrated in FIGS. 2 and 3. The cap body 51 is integrally formed from a resin material such as polyethylene and includes a main part 50 having a generally U-shaped configuration, a pull-tab 52 supported on the main part 50 for turning or pivoting movement about a hinge 54, and a piercing flap 53 also supported on the main part 50 for interlocked turning with the pull-tab 52 about the hinge 54. When the pull-tab 52 is pulled up and turned, the piercing flap 53, interlocked with the pull-tab 52, is also turned to pierce the packing material of the packaging container to which it is applied. The main part also includes a pull-tab holding portion 50*a*. A detent 50*b* is formed on the pull-tab holding portion 50*a* of the main part 50 at a position adjacent the pull tab 52. In this way, the pull-tab 52 is held with the main part 50 by the engagement of the side edge of the pull-tab 52 with the detent 50*b*. Additional details associated with the construction of the cap body, which details are not necessary for an understanding of the present invention, are described in Japanese Laid-Open Patent Application No. Hei-8-132855, the disclosure of which is incorporated herein by reference. It is also possible to use the apparatus of the present invention to apply to a packaging container a cap body having a different configuration and construction than that shown in FIGS. 2 and 3.

A pickup apparatus, which is described below in more detail, is provided for picking up the cap body and subsequently assisting in applying the cap body 51 to the portion of the packaging container to which the cap body is to be applied. This pickup apparatus carries the cap body 51 to a position directly above the burner unit 22 as shown in FIG. 3, and the burner unit 22 then heats the underside periphery of the cap body 51 for a specified period of time.

The pickup apparatus then carries the cap body 51 to a position where the cap body 51 is pressed against the portion of the packaging container where the cap body is to be applied. As a result, the melted polyethylene resin on the underside periphery of the cap body 51 is joined to the polyethylene resin forming the outermost layer on the packaging container surface. Thus, the cap body 51 is applied to the desired region of the packaging container.

Because the flame of the burner unit 22 is brought into direct contact or substantially direct contact with the underside periphery of the cap body 51, the periphery of the cap body 51 is melted within a very short period of time. This increases the processing speed of the cap body applying apparatus. Further, the cost of the cap body applying apparatus can be reduced because a special heating apparatus is not required.

Figure 4:
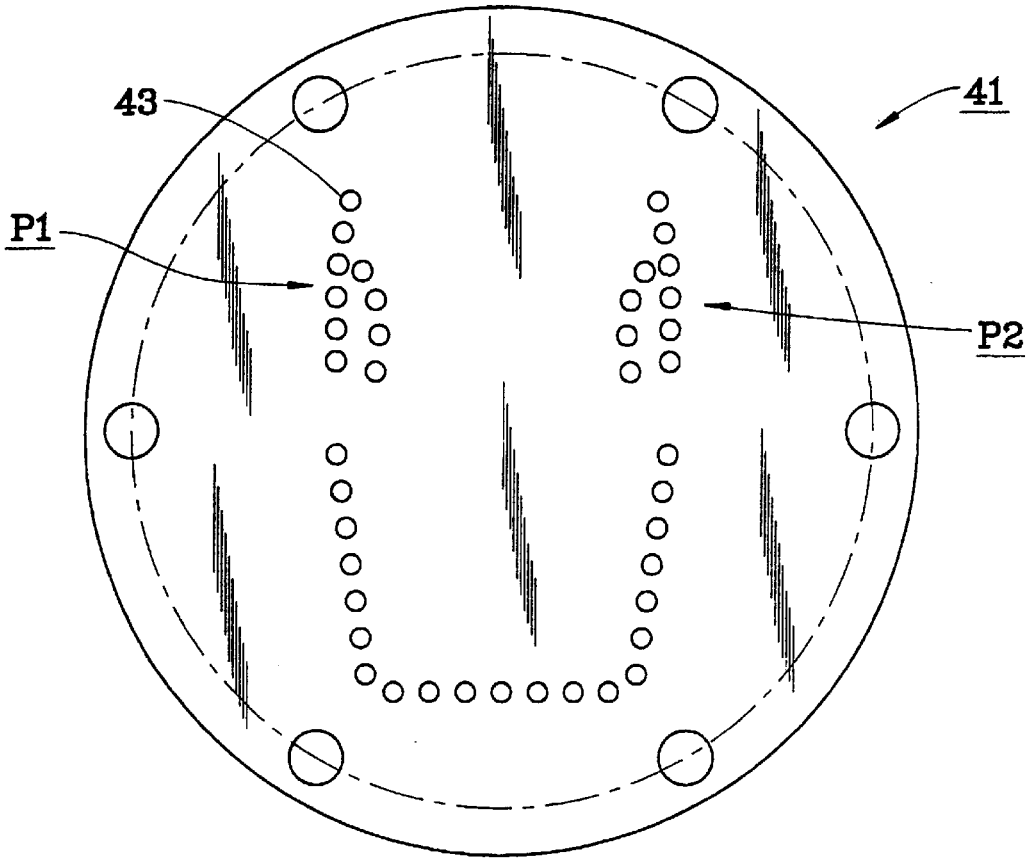
FIG. 4 is a plan view of a burner block used in the cap body applying apparatus of the present invention.
Figure 5:
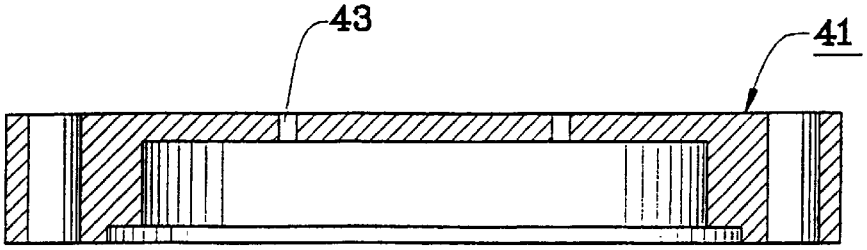
FIG. 5 is a cross-sectional view of the burner block shown in FIG. 4.

The various details associated with the burner unit 22 can be seen with reference to FIGS. 4, 5 and 6. The burner unit 22 includes a burner block 41, a plurality of nozzle securing holes 43 formed in the burner block 41, and a plurality of nozzles 31 adapted to be secured in the nozzle securing holes 43 by way of seal members 45. The nozzles 31 are preferably made of a material having a low heat conductivity.

As seen in FIG. 4, the nozzle securing holes 43 are arranged in a generally U-shaped pattern that generally corresponds in shape to the shape of the underside periphery of the cap body 51. The nozzles 31 which are secured in the nozzle securing holes 43 are thus also arranged in a generally U-shaped pattern. Because relatively large forces are applied to the pull-tab holding portion 50*a* of the main part 50 of the cap body 51 while the pull-tab 52 is opened and closed, the nozzle holding holes 43 are arranged in two rows in the portions of the array of holes 43 designated P1 and P2. These portions P1, P2 correspond in location to the pull-tab holding portion 50*a* of the cap body 51. The provision of two rows of holes 43 in the portions P1, P2 of the hole array results in the heating of slightly wider portion of the underside periphery of the cap body in the areas corresponding to the pull-tab holding portion 50*a* of the cap body 51 to thereby provide a region of greater strength at the packaging container/pull-tab holding portion 50*a* interface.

Each nozzle 31 is constructed as a relatively long pipe of small diameter to create a tiny flame at the tip of each nozzle 31. Since hydrogen-oxygen gas mixture is used as the fuel, the tiny flame created at the tip of each nozzle 31 is stabilized.

By arranging the nozzles 31 along the profile of the cap body 51, only the underside periphery of the cap body 51 is heated and melted. Additionally, as seen in FIG. 4, the nozzle holding holes 43 and the nozzles 31 are arranged so that a portion of the arrangement is devoid of holes and nozzles. This portion of the hole and nozzle arrangement that is devoid of holes and nozzles corresponds in location to the hinge 54 of the cap body. In this way, the hinge 54 of the cap body 51 is prevented from being heated and deformed and so the hinge 54 is not inadvertently or accidentally heated by mistake. Thus, the operation of the hinge 54 on the cap body is not adversely affected.

Because the underside periphery of the cap body 51 is heated and melted with a plurality of flames which are independent of each other, the melting of the cap body can be uniform along the cap body periphery. As a result, the cap body 51 is applied securely to the portion of the packaging container where the cap body 51 is to be applied. Also, unlike the hot melt process, the process of the present invention results in a high strength connection at the cap body/packaging container interface after the application of the cap body to the packaging container.

As noted above, the nozzles are relatively long in length and so the tip of each nozzle 31 is spaced sufficiently far from the surface of the burner block 41. This feature coupled with the nozzles 31 being made of a material having a low heat conductivity advantageously prevents the heat of the flame from being transmitted to the burner block 41. Also, because the nozzles 31 are arranged at constant or generally intervals in a generally U-shaped pattern, all the nozzles 31 are not ignited at the same time with the igniter 32.

FIGS. 7–9 illustrate the manner in which the nozzles 31 are ignited during operation of the apparatus of the present invention. As seen initially with reference to FIG. 7, if the igniter 32 is activated while the hydrogen-oxygen gas mixture is ejected from all the nozzles 31, only the nozzle 31 (or perhaps several nozzles 31) that is located closest to and immediately adjacent the igniter 32 is ignited as shown in FIG. 8 and the rest of the nozzles 31 are not ignited. However, for effective operation of the apparatus, all of the nozzles 31 need to be ignited. For this purpose, a shield plate 57 is employed. This shield plate 57 is placed above the nozzles 31 after the nozzle(s) 31 immediately adjacent the igniter 32 is ignited. Although the hydrogen-oxygen gas mixture ejected from the nozzles 31 which are not ignited tends to rise, the mixture is prevented from rising by the shield plate 57 and instead is deflected to spread laterally along with the lateral air flow produced at this time. Thus, when only the nozzle(s) 31 closest to the igniter 32 is initially ignited, the rest of the nozzles 31 are also subsequently ignited by virtue of the deflected hydrogen-oxygen gas mixture.

Figure 10:
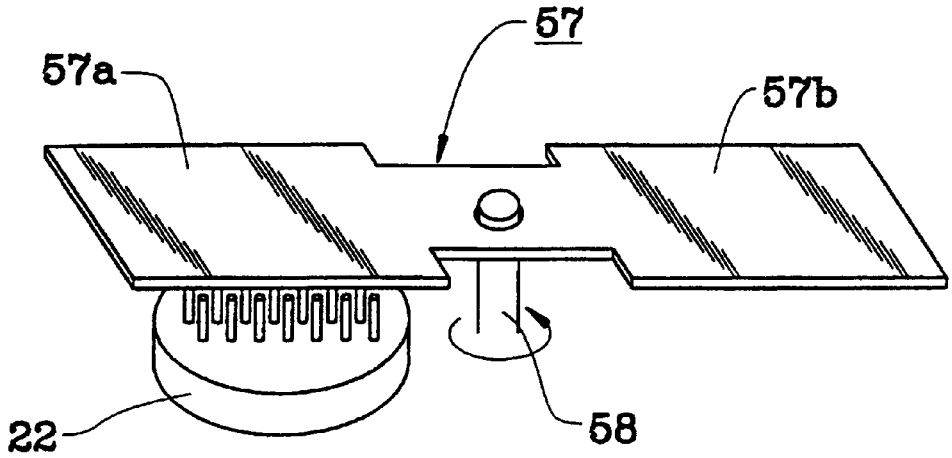
FIG. 10 is a perspective view of the shield plate used in conjunction with the burner unit in accordance with the present invention.

As shown in FIG. 10, the shield plate 57 includes two shield portions 57*a*, 57*b*. The shield plate 57 is rotatably supported on a shaft 58 for rotation in the direction of the arrow. The shaft 58 is connected to driving device which rotatably drives the shield plate 57 in an intermittent manner so that the shield portions 57*a*, 57*b* shield the nozzles 31 from above. More specifically, the shield plate 57 is rotated to shield the nozzles 31 from above after the igniter 31 is activated. The nozzle plate 51 positioned above the nozzles advantageously makes it possible to ignite all of the nozzles 31 with a single igniter 32.

Figure 11:
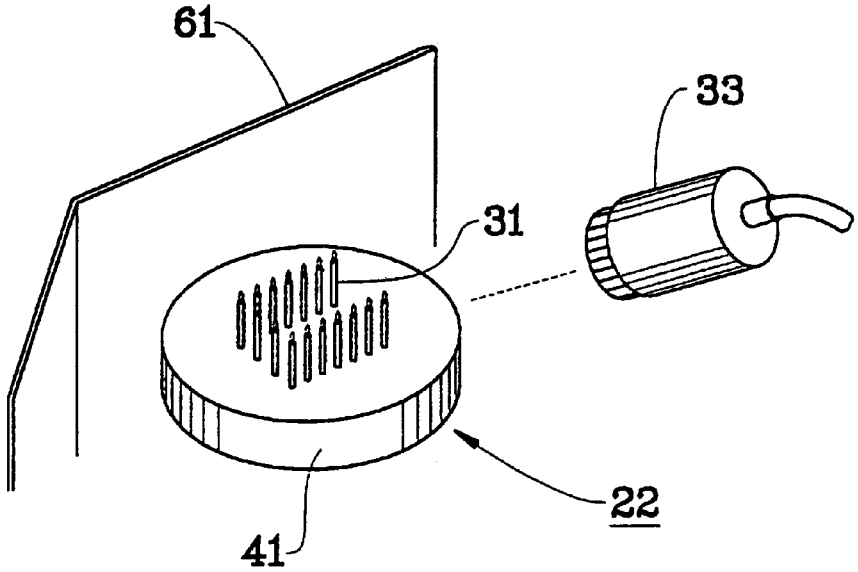
FIG. 11 is a perspective view of the burner unit and the positioning of the flame monitor camera used in the apparatus of the present invention.

Because the nozzles 31 are arranged at generally constant intervals in a generally U-shaped pattern, a plurality of flames have to be simultaneously monitored. A conventional infrared sensor is not well suited for carrying out such a monitoring function as a conventional infrared sensor typically does not permit a plurality of flames to be simultaneously monitored. Thus, the present invention employs the flame monitor camera 33 shown in FIG. 1 to monitor the flames. FIG. 11 illustrates the way in which the flame monitor camera is positioned 33 in the apparatus of the present invention.

As seen in FIG. 11, the flame monitor camera 33 is a CCD camera which recognizes the condition of a plurality of flames as visual data which are analyzed with an analyzing device associated with the controller 35 shown in FIG. 1 to monitor and determine the hue, chroma, and brightness of the flames. To prevent erroneous detection caused by diffused reflection of light, a visor 61 can be placed behind the burner unit 22 as shown in FIG. 11. Further, the burner block 41 can be painted black.

Figure 12:
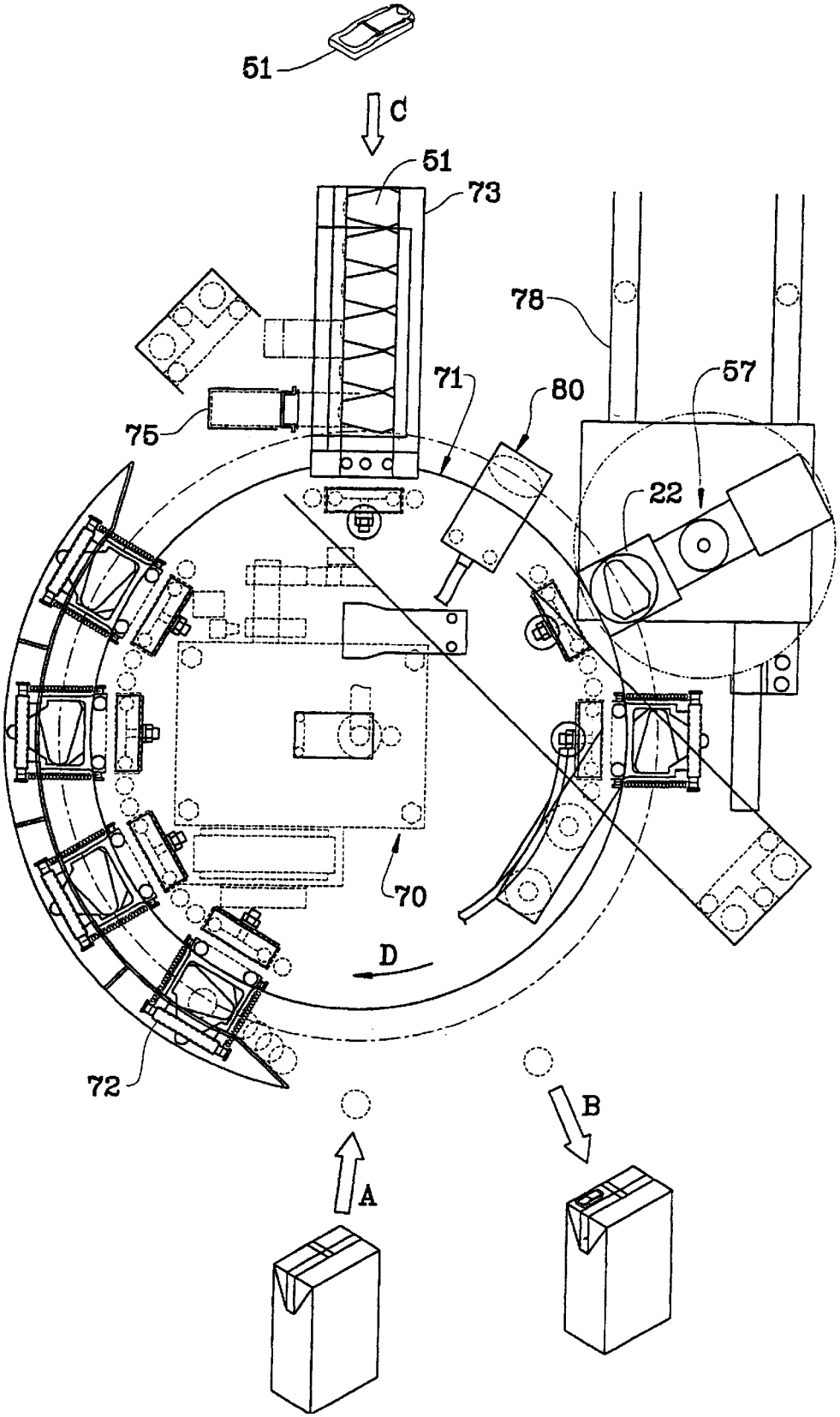
FIG. 12 is a plan view of the overall cap body applying apparatus of the present invention.

Various additional details associated with the overall apparatus for carrying out the cap body applying function and the operational steps performed during the cap applying operation are described below. FIG. 12 illustrates in plan view the cap body applying apparatus of the present invention during operation while FIG. 13 sets forth a cap applying process dime chart depicting the timing of various operations performed during the cap applying process. As seen with reference to FIG. 12, the apparatus is provided with a table 71 that is tuned by a stepping motor 70 in the direction of arrow D, a plurality of packaging container holders 72 mounted on the table 71 for holding individual packaging containers at spaced apart locations around the circumference of the table 71, a conveyor 73 for continuously transporting the cap bodies 51 in the direction of arrow C utilizing pneumatic pressure, and a retracting device 78 for retracting the burner unit 22 when the apparatus detects that a cap body 51 is not being transported. In one respect, the table 71 functions as a transporting device for transporting the packaging container holders 72 and the held packaging containers. The packaging container holders 72 move with rotational movement of the table 71.

Figure 14:
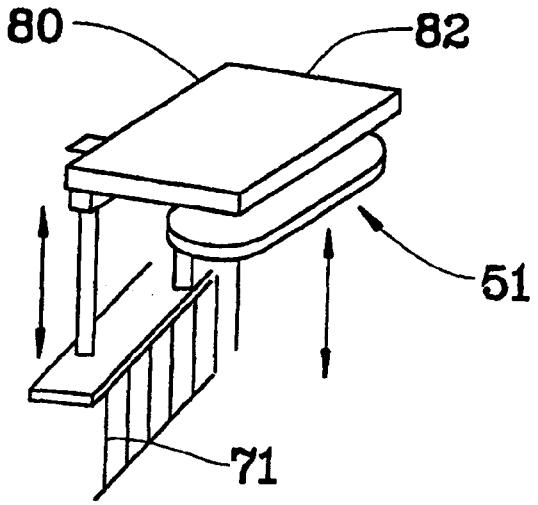
FIG. 14 is a perspective schematic illustration of the pickup apparatus used to pick up the cap body from the positioning device.

The apparatus also includes a plurality of pickup apparatus 80 that are designed to pick-up the cap body 51 from the positioning device 75. Although only a single pickup apparatus 80 is shown in FIG. 12, there are preferably twelve spaced apart pickup apparatus disposed around the periphery of the table 71 at places corresponding in location to the location of the individual packaging container holders 72. The pickup apparatus 80 are mounted on the table 71 so that they rotate with the table 71. Thus, the table also serves as a transport device for the pickup apparatus 80. As seen in FIG. 14, each pickup apparatus 80 preferably includes a plate 82 connected to a source of vacuum for holding the cap body by vacuum. The pickup apparatus 80 is vertically movable in an up and down manner as shown by the double headed arrows in FIG. 14.

Figure 15:
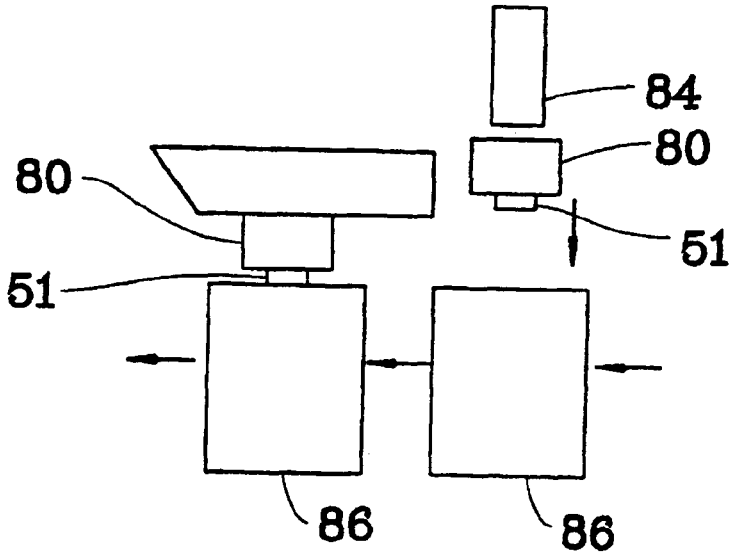
FIG. 15 is a schematic illustration of the pusher device that is provided at the applying station for applying a cap body to the packaging container.

The apparatus is also provided with a pusher device 84 shown in FIG. 15. The pusher device 84, which is positioned at the cap applying station described below, is designed to push the pickup apparatus 80 downwardly so that the cap body 51 held by the pickup apparatus 80 is applied to the exterior surface of the packaging container 86.

As shown in FIG. 12, a packaging container transported in the direction of arrow A is placed in the adjoining packaging container holder 72 and is rotatably transported by intermittent motion in the direction of arrow D through rotational movement of the table 71. The table 71 preferably intermittently rotates and stops at twelve locations between the location designated by the arrow A where the packaging containers are loaded into the holders 72 and the location designated by the arrow B where the packaging containers with the applied cap body are discharged from the apparatus. There are six stations or stops between the in-feed location designated by arrow A and the conveyor 73, and six stops or stations between the conveyor 73 and the discharge location designated by the arrow B.

A cap body 51 transported by the conveyor 73 in the direction of arrow C is positioned by a positioning device 75 so that the cap body 51 can be picked up by the pickup apparatus 80. The pickup apparatus 80 moves downwardly to pick up the cap body 51 positioned by the positioning device 75. The pickup apparatus 80 holds the cap body 51 by vacuum and moves upwardly with the held cap body 51. The pickup apparatus 80 then transports the cap body 51, through rotation of the table 71, in the circumferential direction of the table 71. The cap body 51 is delivered by the pickup apparatus to a heating position where it is positioned over the burner unit 22 so that the underside periphery of the cap body 51 is heated and melted.

At this time, the cap body 51, while still being held by the pickup apparatus, is moved to an applying station. The cap body 51 with the heated and melted underside periphery is then pushed downwardly by the pusher device 84, where the cap body 51 is pressed against and applied to the desired portion of the packaging container. Once the cap body 51 is applied to the packaging container, the packaging container is discharged in the direction of arrow B.

During the aforementioned operation, the burner unit 22 is normally in the forward extended position. However, if the cap body 51 is not being transported, a sensor detects the absence of a cap body 51 and the burner unit 22 is then retracted. Therefore, the pickup apparatus is prevented from being overheated and burned by the burner unit 22.

Figure 13:
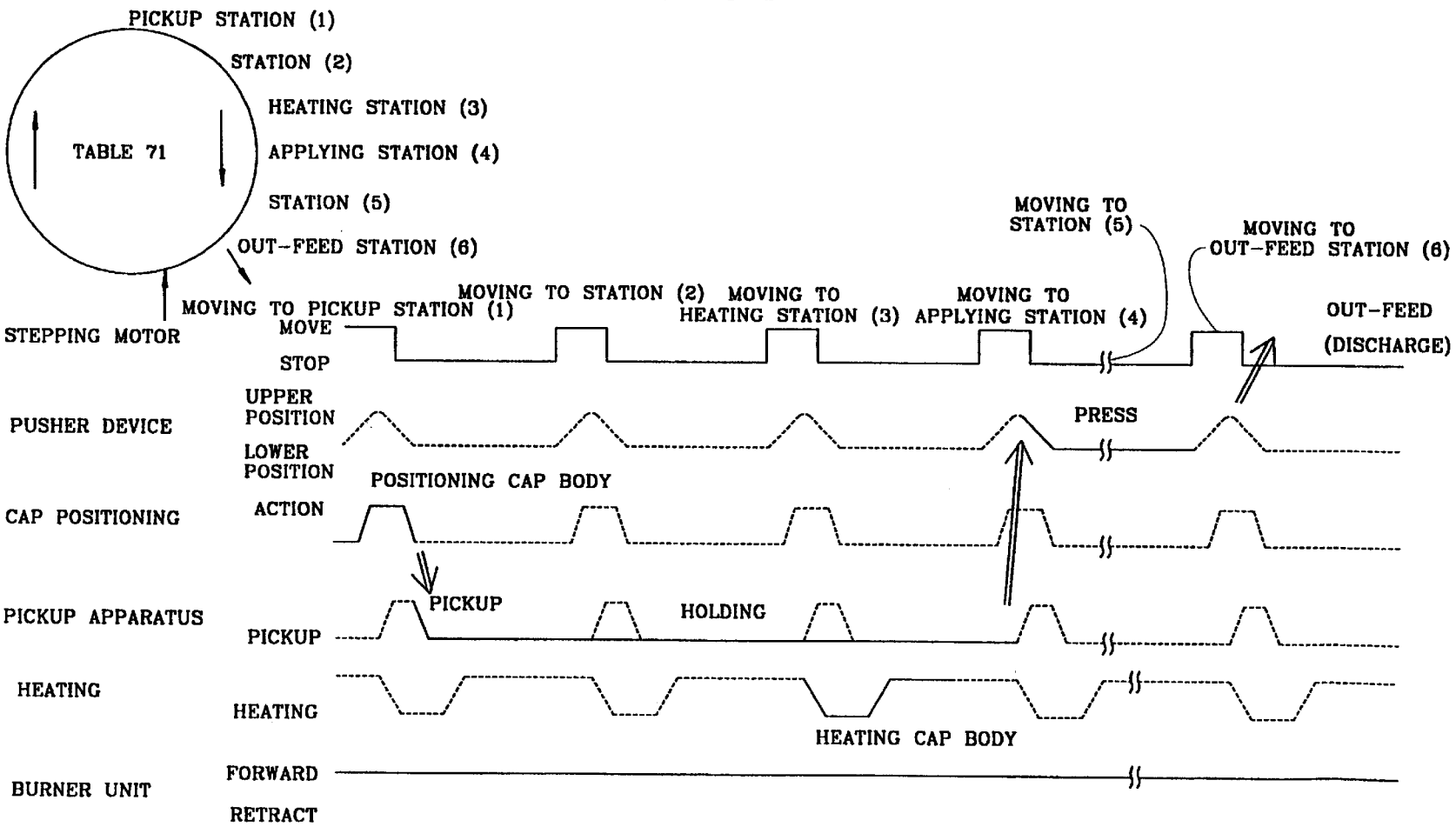
FIG. 13 is a time chart illustrating the relative tuning of various operations associated with the operation of the cap body applying apparatus of the present invention.

FIG. 13 illustrates a timing chart associated with the operation of the apparatus depicted in FIG. 12. The timing chart illustrates the relative timing aspects associated with operation (i.e., "move") and non-operation (i.e., "stop") of the stepping motor 70, the movement of the pusher device 80 between the upper and lower positions, the operation (i.e., "action") and non-operation of the cap positioning device 75, the pickup and holding operations of the pickup apparatus 80, the heating and non-heating action of the burner unit 22, and the forward and retracted positioning of the burner unit.

As mentioned above, a packaging container intermittently advanced from the in-feed location at arrow B stops at the pickup station (1) shown in FIG. 13. As the packaging container approaches the pickup station (1), the cap positioning device begins to position the cap body 51 where it is picked up by the pickup apparatus 80. The pickup apparatus 80, while holding the cap body 51, is then advanced through rotation of the table 71 to station (2) shown in FIG. 13 where the pickup apparatus 80 stops. Station (2) is a resting station where the cap body 51 is held by the pickup apparatus 80 until the next intermittent movement of the table 71. Further advance of the pickup apparatus through rotation of the table 71 positions the pickup apparatus 80 at the heating station (3) wherein the table 71 once again stops. The cap body 51 being held by the pickup apparatus 80 at the heating station (3) is heated on its underside periphery by the burner unit 22. After heating, the table 71 and the pickup apparatus 80 holding the cap body 51 with the heated underside periphery are advanced to the applying station (4) and stopped. At the applying station (4), the pickup apparatus 80 is pushed downwardly by the pusher device 84 so that the cap body 51 held by the pickup apparatus 80 is applied to the packaging container. While the cap body 51 is being pressed against the packaging container, the table 71 is rotated to station (5) shown in FIG. 13 where it is stopped. Station (5) constitutes another resting station. The table 71 is subsequently advanced so that the packaging container with the applied cap body 51 is moved to the out-feed station (6) where the rotation of the table 71 once again stops. At the out-feed station (6) the packaging container with the attached cap body is discharged from the apparatus. Although not specifically shown in FIG. 13, if the absence of a cap body is detected, the burner unit is retracted to avoid damaging the pickup apparatus.

The apparatus and method according to the present invention allow realization of a variety of advantages. In one respect, because the hydrogen-oxygen gas mixture supplied from the gas generating device is burned in the burner unit, it is not necessary to store the hydrogen-oxygen gas mire. It is thus possible to reduce the area occupied by the cap body applying apparatus.

In addition, air is not required for burning the hydrogen-oxygen gas mixture and no carbon dioxide is produced by the burning. As a result, restrictive requirements for installing the cap body applying apparatus are eliminated.

Furthermore, because hydrogen gas is highly diffusive, the apparatus is relatively safe should a leak occur. Also, because a hydrogen-oxygen gas mixture is used as the fuel, it is possible to create a relatively stabilized tiny flame at the tip of each nozzle. Thus, by arranging the nozzles along the profile of the cap body, only the underside periphery of the cap body is heated and melted without heating and melting other undesired portions of the cap body. It is also possible to prevent the hinge portion of the cap body from being inadvertently and undesirably heated and deformed by mistake.

By heating and melting the underside periphery of the cap body through use of a plurality of flames which are independent of each other, the melting can be effected in a relatively uniform manner along the periphery of the cap body. As a result, the cap body is applied securely to the desired portion of the packaging container. This is also advantageous from the standpoint of providing a high strength connection of the cap body to the packaging container while at the same time achieving a good seal after application of the cap body to the packaging container.

The provision of the shield plate that can be selectively disposed over the nozzles is also quite advantageous in that the plurality of nozzles which are arranged in a pattern that corresponds to the underside periphery of the cap body can be ignited through use of a single igniter.

The use of the CCD camera for monitoring the flame of each of the nozzles is highly useful in that it makes it possible to simultaneously monitor all of the flames emitted by the plurality of nozzles that are arranged in a pattern that corresponds to the shape of the underside periphery of the cap body.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An apparatus for supplying and applying cap bodies to a packaging container, comprising:

a gas supplying device for supplying a hydrogen-oxygen gas mixture obtained by electrolyzing water;

a burner unit connected to the gas supplying device for receiving the hydrogen-oxygen gas mixture from the gas supplying device and burning the hydrogen-oxygen gas mixture;

a pickup apparatus for transporting a cap body to a heating position above said burner unit, said burner unit being provided with a plurality of nozzles arranged in a pattern corresponding in shape to an underside periphery of the cap body, with each of the nozzles producing a tiny flame.

2. An apparatus according to claim 1, including a shield plate positionable above said nozzles to deflect the hydrogen-oxygen gas mixture emitted from the nozzles, and an igniter disposed adjacent one of said nozzles.

3. An apparatus according to claim 1, including a CCD camera for monitoring the flame emitted from each of said nozzles.

4. An apparatus according to claim 3, including a gas detector for detecting gas leakage.

5. An apparatus according to claim 4, including a controller to which said CCD camera and said gas detector are connected.

6. An apparatus according to claim 1, wherein the burner unit includes a burner block having a plurality of holes, each of the nozzles being positioned in one of the holes.

7. An apparatus for supplying and applying cap bodies to a packaging container, comprising:

a gas generator for supplying a gas mixture;

a burner unit connected to the gas generator for receiving the gas mixture, the burner unit including a plurality of nozzles from which the gas mixture is emitted, the nozzles being arranged in a pattern corresponding in shape to an underside periphery of the cap body that is to be applied to the packaging container;

an igniter for igniting the gas mixture emitted from the nozzles to produce a tiny flame from each nozzle;

a transport device;

a pickup apparatus mounted on the transport device for holding a cap body, the pickup apparatus being transported by the transport device to a heating position above said burner unit to permit an underside surface of the cap body to be heated by the flame from the nozzles and being transported from the heating position to an applying position at which the cap body is applied to a packaging container; and a packaging container holder for holding a packaging container to which is to be applied the cap body.

8. An apparatus according to claim 7, including a shield plate positionable above said nozzles to deflect the gas mixture emitted from the nozzles.

9. An apparatus according to claim 7, wherein the nozzles are arranged in a generally U-shaped pattern.

10. An apparatus according to claim 7, wherein the packaging container holder is mounted on the transport device.

11. An apparatus according to claim 10, wherein the transport device is a rotatable table.

12. A process for applying a cap body to a packaging container comprising:

positioning a cap body adjacent a burner unit that includes a plurality of nozzles that each emit a tiny flame, said cap body having an underside surface and said nozzles being arranged in a pattern corresponding in shape to an underside periphery of the cap body;

heating the underside surface of the cap body with the flames that are emitted from the nozzles of the burner unit;

applying the cap body with the heated underside surface to a packaging container to secure the cap body in position on the packaging container.

13. A process according to claim 12, wherein the nozzles are arranged in a generally U-shaped pattern.

14. A process according to claim 12, wherein the cap body is moved by a conveyor to a position where the cap body is picked up by a pickup apparatus.

15. A process according to claim 14, wherein the cap body is transported to a position adjacent the burner unit by rotation of a table on which is mounted the pickup apparatus.

16. A process according to claim 12, wherein the packaging container is intermittently rotatably advanced by a rotatable table.

17. A process according to claim 12, including the step of igniting all of said nozzles with a single igniter.

18. A process according to claim 12, wherein the flames produced by the nozzles are produced by burning a hydrogen-oxygen mixture, said hydrogen-oxygen mixture emitted from the nozzles being deflected by a shield.

19. A process according to claim 12, including retracting the burner unit upon sensing the absence of a cap body adjacent the burner unit.

20. A process according to claim 12, including monitoring the flames emitted by said nozzles with a CCD camera.

* * * * *